US008695303B2

(12) United States Patent
Swanson

(10) Patent No.: US 8,695,303 B2
(45) **Date of Patent: *Apr. 15, 2014**

(54) PANELS INCLUDING TRAP LOCK ADAPTOR STRIPS

(75) Inventor: Lief Eric Swanson, Vero Beach, FL (US)

(73) Assignee: Top Down Siding, LLC, Vero Beach, FL (US)

( * ) Notice: Subject to any disclaimer, the term of this patent is extended or adjusted under 35 U.S.C. 154(b) by 105 days.

This patent is subject to a terminal disclaimer.

(21) Appl. No.: 12/194,979

(22) Filed: Aug. 20, 2008

(65) Prior Publication Data

US 2009/0007517 A1 Jan. 8, 2009

Related U.S. Application Data

(63) Continuation-in-part of application No. 11/774,247, filed on Jul. 6, 2007, now Pat. No. 7,712,277, and a continuation-in-part of application No. 12/018,416, filed on Jan. 23, 2008, now abandoned.

(51) Int. Cl.
*E04D 13/08* (2006.01)

(52) U.S. Cl.
USPC ..... 52/553; 52/523; 52/539; 52/541; 52/546; 52/551; 52/478

(58) Field of Classification Search
USPC ..... 52/511, 513, 518, 519, 523, 539, 541, 52/546, 549, 551, 553, 560, 478, 94–96
See application file for complete search history.

(56) References Cited

U.S. PATENT DOCUMENTS

| | | | | | |
|---|---|---|---|---|---|
| 492,736 | A | | 2/1893 | Shull | |
| 720,893 | A | | 2/1903 | Charlebois | |
| 1,931,709 | A | * | 10/1933 | Schaffert | 52/314 |
| 1,986,739 | A | | 1/1935 | Mille | |
| 2,110,579 | A | * | 3/1938 | Robinson | 52/560 |
| 2,241,642 | A | * | 5/1941 | McCauley | 52/539 |
| 2,831,218 | A | * | 4/1958 | Stark | 52/539 |
| 3,046,700 | A | * | 7/1962 | Davenport | 52/409 |
| 3,173,229 | A | * | 3/1965 | Weber | 52/547 |
| 3,217,453 | A | | 11/1965 | Medow | |
| 3,228,164 | A | * | 1/1966 | Ettore | 52/539 |
| 3,261,136 | A | * | 7/1966 | Abner et al. | 52/471 |
| 4,065,899 | A | | 1/1978 | Kirkhuff | |
| 4,096,679 | A | | 6/1978 | Naz | |
| 4,672,789 | A | | 6/1987 | Fortier | |
| 4,718,214 | A | | 1/1988 | Waggoner | |
| 5,016,415 | A | | 5/1991 | Kellis | |
| 5,475,960 | A | | 12/1995 | Lindal | |

(Continued)

*Primary Examiner* — Brian Glessner
*Assistant Examiner* — Adriana Figueroa
(74) *Attorney, Agent, or Firm* — Malin Haley DiMaggio & Bowen, P.A.

(57) ABSTRACT

Exterior building siding for aesthetic and protection of the building against wind, rain and solar energy by attaching each horizontal plank from the top of the wall downwardly that includes a starting strip where each plank is interlocked to the plank above it. Each of the horizontal planks includes a top wall portion that fits snuggly into an "L-shaped" groove above it so that the panels can be firmly locked together vertically in a downwardly fashion to prevent any wind uplift against the siding or moisture intrusion. In the preferred embodiment, an adaptor strip is bonded to a conventional siding plank for trap lock engagement. Each adaptor strip has a longitudinal recess to reduce mass and volume and a mid panel support for strength.

2 Claims, 11 Drawing Sheets

(56) References Cited

U.S. PATENT DOCUMENTS

| | | | | | |
|---|---|---|---|---|---|
| 5,502,940 | A | | 4/1996 | Fifield | |
| 5,634,314 | A | | 6/1997 | Champagne | |
| 5,657,585 | A | * | 8/1997 | Zaccagni | 52/94 |
| 5,675,955 | A | * | 10/1997 | Champagne | 52/521 |
| 5,711,117 | A | * | 1/1998 | Zaccagni et al. | 52/94 |
| 6,226,947 | B1 | * | 5/2001 | Bado et al. | 52/483.1 |
| 7,713,615 | B2 | * | 5/2010 | Black et al. | 428/294.7 |
| 7,762,040 | B2 | * | 7/2010 | Wilson et al. | 52/748.1 |
| 2003/0014936 | A1 | * | 1/2003 | Watanabe | 52/518 |
| 2005/0166529 | A1 | * | 8/2005 | Rodolofo et al. | 52/716.1 |
| 2007/0130871 | A1 | * | 6/2007 | Johnson et al. | 52/547 |
| 2008/0155928 | A1 | * | 7/2008 | Weiss | 52/546 |
| 2009/0313934 | A1 | * | 12/2009 | Carlson | 52/483.1 |

* cited by examiner

PANELS INCLUDING TRAP LOCK ADAPTOR STRIPS

BACKGROUND OF THE INVENTION

1. Field of the Invention

This invention relates generally to a building protective and aesthetic siding that is used to cover the exterior of a building and, specifically, to a building siding that includes horizontal planks that are interlocked together on top and bottom and that are installed from the top of a building wall in a downward direction. The invention includes the use of an adaptor strip that can be adhesively affixed to existing fiber cement siding planks or comparable material while providing for top down interlocking of the planks for durability and protection from wind and rain.

2. Description of Related Art

Many buildings, residential dwellings and office buildings, use building siding on the exterior of the building for protecting the building from the elements and for aesthetic purposes. Typical building siding is constructed of a plurality of elongated, horizontal panels, planks, or strips that are typically overlapped from the wall bottom upwardly, with each next piece added that overlaps the piece below it. Such overlapping panels are used to protect the building from rain, solar and wind damage. The siding used on many residential and commercial buildings for the exterior is typically made of wooden planks that are overlapped, typically from the wall bottom upwardly. Plastic, polyvinyl chloride (PVC), and aluminum sheets have also been used. Many of these materials are also sloped to aesthetically look like wood planks that are overlapped, one on top of the other giving each plank a slight incline instead of a substantially flat surface.

One of the problems with conventional siding that is constructed with panels or planks from the wall bottom up, i.e. each horizontal plank being covered by one on top of it, is that high winds can lift a plank reducing the siding durability.

The siding described herein adds durability and protection from wind and rain because the siding planks are placed on the building from the top down. Each of the individual horizontal planks are more securely held in place because of the top and bottom interlock connections.

The present invention can be used with existing planks such as fiber cement siding by utilization of an adaptor strip that is adhesively affixed to each existing fiber cement siding plank that allows the fiber cement siding plank to be interlocked from the top down for greatly improving durability and protection from wind and rain. Each plank and adaptor strip is fastened to the building exterior wall along the base area of the adaptor strip.

SUMMARY OF THE INVENTION

Exterior building siding which may be constructed of several types of materials including aluminum, polyvinyl chloride (PVC), wood, steel, concrete, hard foam or other synthetic materials having essentially two components which include: (1) a top starting strip that is affixed to the building at a selected upper beginning point of a building wall or structure and (2) a plurality of planks of the same or variable lengths that are affixed to the starting strip and to the building itself, usually to vertical studs forming the building exterior wall.

The starting strip is the uppermost horizontal strip and has an inverted "J-shaped" cross section. The strip body inverted "J-shaped" cross sectional configuration provides for a substantially upside down deep recess or groove that is disposed vertically and is tapered to receive the upper "L-shaped" lip portion of the first horizontal mounting plank. The starting strip may have a plurality of small circular recessed dimples that provide visual alignment for fasteners such as screws, nails or staples to be driven through the strip in such a manner that the head of the screw or nail is flush or countersunk below the level of the exterior surface. The strip can also be attached by glue. After the top starting strip has been fastened to the selected upper position on the building exterior wall, the horizontal siding planks are attached sequentially downwardly from the starting strip. The planks may be rectangular in shape of the same or different lengths that can be cut to make each horizontal row equal to the building wall width. Each plank has a cross section that includes a top tapered "L-shaped" area that is upright and a bottom "J-shaped" area that is inverted forming a groove. In one embodiment, the upper length of the "L-shaped" area leg of each plank is longer that the bottom portion of the "J-shaped" leg as described below.

The planks used in the siding are joined and interlocked vertically on top and bottom in horizontal rows, and are arranged in end to end abutments. The planks can be manufactured in various dimensions in terms of width or height and thickness and can be of different lengths depending on the nature of the building to be covered with siding. Each plank can be cut in length and width to fit any wall size.

The starting strip inverted "J-shaped" cross section area has a continuous groove from end to end that may be tapered and is sized to snuggly fit with the upper "L-shaped" projection of the top edge of the siding plank. Thus, when the first plank is inserted snuggly into the starting strip, there is a tight fit between both the starting strip groove and the first plank projection.

At the bottom of the every plank, there is an inverted "J-shaped" area with a groove similar to the groove inverted "J-shaped" groove in the starting strip. This plank lower groove is interlocked with the top edge of the next horizontal plank added downwardly.

The starting strip and each plank are attached to the building exterior wall surface or studs by nails, screws, staples or glue. The heads of the nail and screw fasteners may be countersunk in pre-formed recessed areas. Assembly of an exterior wall of siding begins with the attachment of the starting strip at a location that denotes the horizontal upper starting line of the siding. The starting strip is nailed, screwed, stapled or glued to the building horizontally.

A first series of planks are horizontally pushed into firm engagement in the starting strip groove and each plank is nailed, screwed, stapled or glued into place along the bottom area of each plank forming the first row of planks.

Each additional row of planks is engaged to the fastened planks downwardly, one row at a time. The fasteners securing the previous planks are covered by the next row of planks.

The planks forming the very bottom row may have to be cut longitudinally for a perfect fit to reduce their height to conform to the remaining space to be covered. These planks may be glued to the building exterior wall or studs.

In one embodiment, the inside (back) surfaces of the starting strip and all planks are flat and form a flat plane flush with the building wall or studs.

In an alternate embodiment, the back wall surface of each plank and the starting strip can include one or more vertical recessed channels (curved or rectangular in shape) that form vertical moisture or fluid conduits that allow drainage of moisture that accumulates on the outside exterior surface of the building but on the inside of the planks to dissipate moisture in the vertical channels by gravity.

Also in an alternate embodiment, the plank end faces that are placed side by side for each plank, instead of being flush, could include a groove flange overlap such that the outer surface edge of one plank overlaps the inner side edge of the adjacent planks. Between each overlap structure a small vertical space can be made as a moisture channel.

In a further alternate embodiment, the starting strip and planks can be installed onto the roof of a building as well as the soffits of a building. In this alternate embodiment, the starting strip and planks are installed in the same top-down manner as described when used for siding.

Using the present invention as described, it is noted how secure each of the individual planks are, both at the top and at the bottom, which greatly increases its durability against harsh weather elements such as wind and rain for greater strength and longer preservation.

In the preferred embodiment, the siding is comprised of a conventional elongated plank made of fiber cement or other material, that is adhesively attached or bonded to an elongated adaptor strip which allows fiber cement conventional planks of siding to be securely trap locked above and below against a building horizontally from the top of the building wall downwardly.

The adaptor strip is an elongated strip, which may be extruded, milled or molded from various materials, that includes a front flat face in its upper portion, a mid panel support on its rear face to prevent or reduce the cement board damage due to flying debris, extra material for increase strength near a recessed area that runs the entire length of the adaptor strip to reduce the volume of material used and a lower extended nailing or fastener flange.

The adaptor strip can be affixed with adhesive to the fiber cement board at the factory. The siding unit is comprised of the conventional fiber cement board or other material and is bonded to the adaptor strip that provides horizontal planks attached vertically for interlocking at top and bottom of each fiber cement panel or plank. The siding unit has a bottom or base groove that is large enough to receive the top flat edge of a fiber cement board that is trap locked between the adaptor strip and the base of an above fiber cement board that is already attached to a building exterior along its base area.

Optionally, within the base groove, a resilient elongated moisture barrier member is placed at the top surface of the inverted groove. The moisture stop could be longitudinally disposed throughout the base groove of the entire plank and adaptor strip. As each cement fiber board is interlocked below to the previously attached groove plank, the top edge engages and self-aligns at the stopping point in the inverted groove with or without the moisture stop. The moisture stop reduces moisture from reaching the exterior building wall being covered or the siding fasteners from the front surface.

Also in the preferred embodiment with the adaptor strip, the back face surfaces of the adaptor strip include narrow moisture transmission grooves that are substantially diagonally and vertically positioned but can be angled. The adaptor strip back surface moisture grooves are used in conjunction with an adaptor strip horizontal recess in the adaptor strip that reduces the volume of material used in the device. The adaptor strip mid panel support back face also includes a series of moisture transmission grooves substantially positioned diagonally and vertically.

The longitudinal recess in the adaptor strip may be trapezoidally shaped in cross section (as opposed to rectangular) so that moisture will not accumulate due to gravity allowing moisture to run down the recess wall surface between moisture transmission grooves.

Thus, each siding panel horizontally attached to an exterior building wall is mounted from the top down, interlocking each lower panel is comprised of a fiber cement board or other material that can be made in a conventional rectangular shape with an adaptor strip adhesively bonded to the back side of the fiber board. The siding unit can be interlocked and fastened along its extended base area with the adaptor back wall face extending below the front of the fiber board to allow for fasteners such as nails, screws or staples to be fastened along the base to a building wall. The adaptor strip can have a large longitudinal recess specifically to reduce the volume of material used in the entire siding unit while, at the same time, not sacrificing strength.

It is an object of this invention to provide a building exterior siding that is affixed from the top down with an interlock cross sectional pattern between adjacent horizontal panels to give the siding more strength and durability in use.

It is another object of this invention to provide an improved exterior panel that can be easily assembled and mounted on the exterior of a building in a top down progression for increased strength and durability of the siding.

It is a primary objective of this invention to provide siding that can be made from fiber cement or other conventional material and bonded to an adaptor strip that allows for rigid interlock from a top down construction of the siding for fastening along the base of each siding unit and may provide for moisture transmission grooves along the interface between the adaptor strip and the building exterior wall to which it is attached.

In accordance with these and other objects which will become apparent hereinafter, the instant invention will now be described with particular reference to the accompanying drawings.

PREFERRED EMBODIMENT OF THE INVENTION

Figure 1:
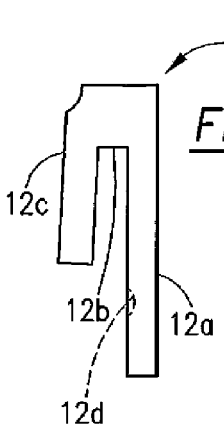
FIG. 1 shows a side elevational view of the top starter strip.
Figure 3:
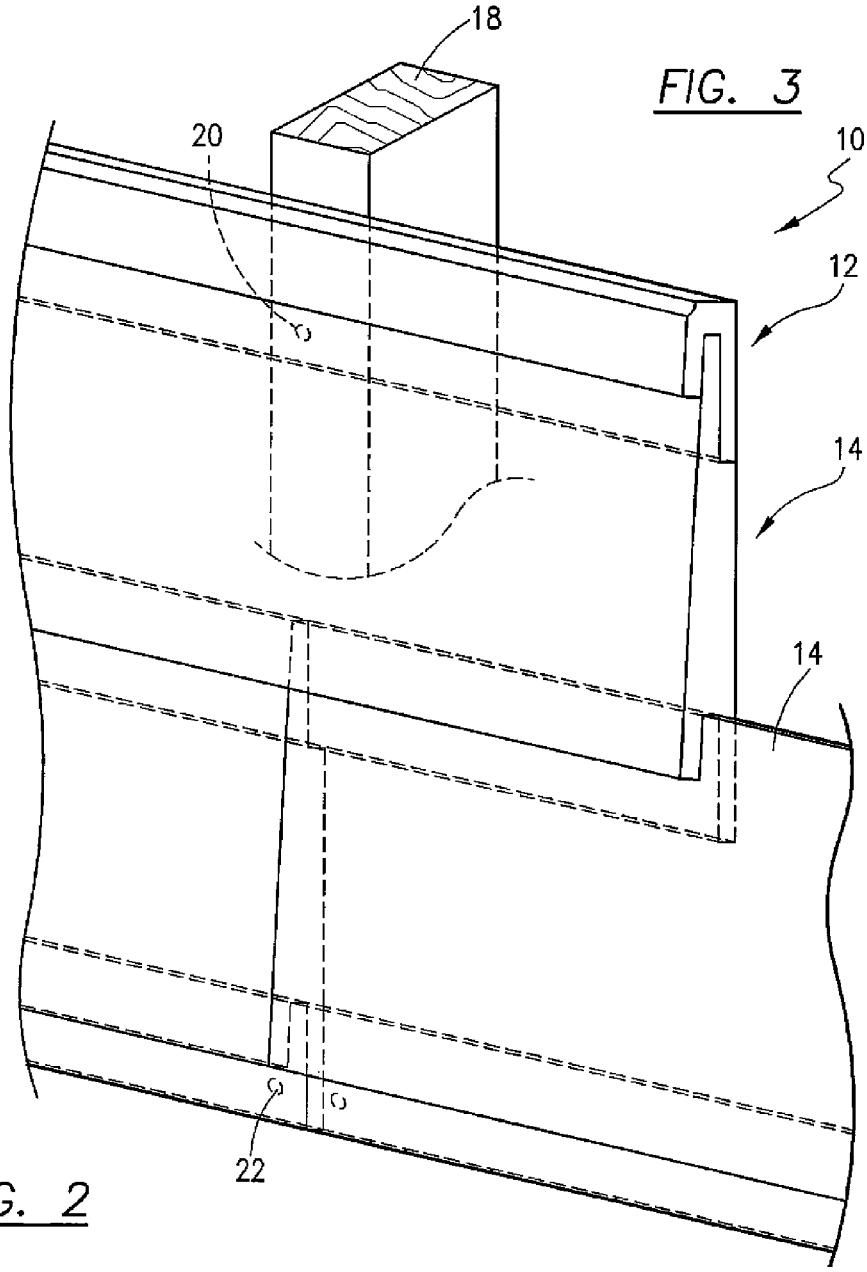
FIG. 3 shows a perspective view partially cut away of the exterior siding including the starting strip and two planks installed on the exterior of a building.

Referring now to the drawings and, particularly, FIG. 1, the starting strip 12 is shown in a side elevational view to illustrate the "J-shaped" groove that is inverted 12*b* formed between the back wall of the starting strip 12*a* and the front wall 12*c*. The starting strip 12 also includes a plurality of dimples 12*d* that are circular recessed portions sized approximately in diameter to equal to the head of a nail or a screw. However, the dimples are not required. This provides a visual indication to a construction worker as to where to insert fasteners such as nails or screws that will be countersunk when the starter strip is mounted to a vertical wall surface or stud 18 as shown in FIG. 3.

It is further contemplated that each starting strip 12 may additionally have a plurality of shallow vertical grooves located on the flat back wall. These grooves will extend from the top of the flat back wall to the bottom of the flat back wall.

Figure 2:
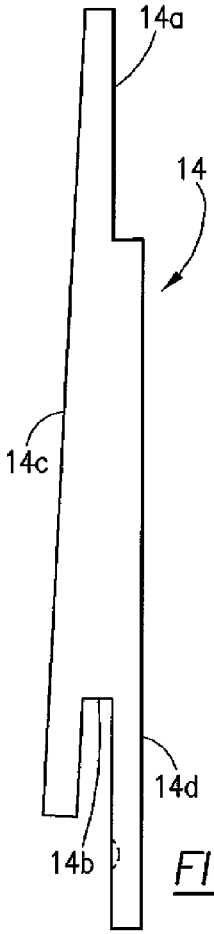
FIG. 2 shows a side elevational view of a typical horizontal plank.

Referring now to FIG. 2, the basic siding plank 14 is shown that is used to complete the building siding. Each plank 14 is mounted horizontally starting from the starting strip 12 as shown in FIG. 3 downwardly in horizontal rows. The plank 14 has a flat back wall 14*d* and an upper "L-shaped" wall 14*a* which is slightly tapered and fits snuggly within the inverted "J-shaped" groove 12*b* of the starting strip shown in FIG. 1. It is contemplated that the structure 12 may have a "J-shape" with an interior non-parallel, tapered "V-shaped" groove 12*b* to provide a tapered exterior surface. The top "L-shaped" portion 14*a* also is sized to fit snuggly in an adjacent horizontal plank into the inverted "J-shaped" groove 14*b* as each horizontal plank is attached to the plank above it in a downward pattern. The front surface of each plank is flat but tapered to give the effect of overlapping boards and to allow water run off.

It is further contemplated that each siding plank 14 may additionally have a plurality of shallow vertical grooves located on the side of the plank 14 which will share a planar relationship with the flat back wall of the starting strip 12. These grooves will extend from the top edge to the bottom edge of the plank 14.

Looking at FIG. 3, the starting strip is shown attached to a vertical stud 18 which is the exterior wall stud for the building. Also shown in FIG. 3 are two planks 14 connected to each other vertically. The planks may have dimples 20 and 22 that are also visual representations of where to place the appropriate fasteners such as nails, screws, staples or glue when attaching each plank 14 to a vertical wall surface or stud 18.

Figure 4:
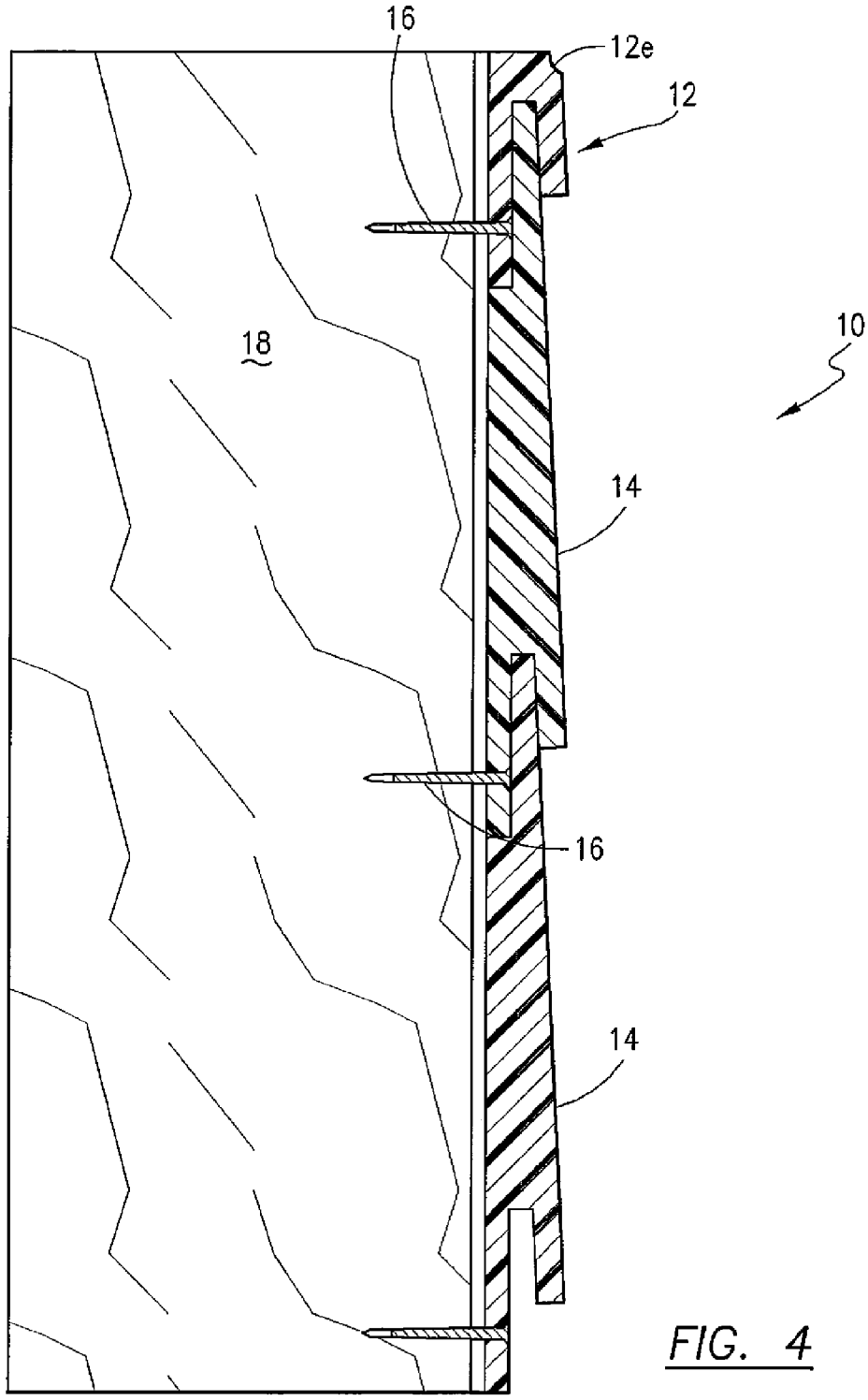
FIG. 4 shows a side elevational view partially in cross section of the building siding attached to a portion of a building wall.

Referring now to FIG. 4, the siding is shown with the starting strip 12 mounted at the top of a representative wall surface or stud 18 and is interlocked with the first horizontal row 14 plank with a fastener 16 that has been attached to the starting strip 12 at the top. Subsequently, the first horizontal plank 14 is fastened into the inverted groove in starting strip 12 at the top and with a fastener 16 at its bottom securely fastening the horizontal plank to the starting strip and to the wall surface or stud at its base. Thus, the sequence repeats from the top down of inserting the next row of horizontal planks and attaching them to the wall surface or stud with fasteners such as nails, screws, staples or glue. The fasteners at the base of each plank are covered by the next plank inserted from below by wall 14*a* FIG. 2.

Looking at FIGS. 3 and 4, one can easily see how strong and tight the siding is mounted on the building exterior wall. It would be difficult for the wind or rain to penetrate the siding in the interlocking configuration as shown.

Looking at FIG. 4, the top starting strip 12 can also include a decorative edge chime 12*e* if desired. Also, as shown in FIGS. 3 and 4, the horizontal planks 14 have a front façade that is visible after installation that includes a beveled or inclined shape to achieve the lap style look. However, any other façade can be utilized on the front exterior surface.

The back surfaces 12*a* and 14*d* are flat. The siding planks 14 and starting strip 12 can be made in various widths and thicknesses and lengths and from many different materials including mixed fibers, wood, concrete, steel, aluminum, plastics, polymers, foam or other blended or natural or man-made composite materials. The siding can function not only as a protective outer layer on a building protecting the building against wind, moisture, rain and solar energy, but also acts as an insulation for heat or cold. Overall, the siding provides greater uplift protection from stronger than average wind and moisture intrusion that results in a reduction of costly repairs and replacements to the building.

Figure 5:
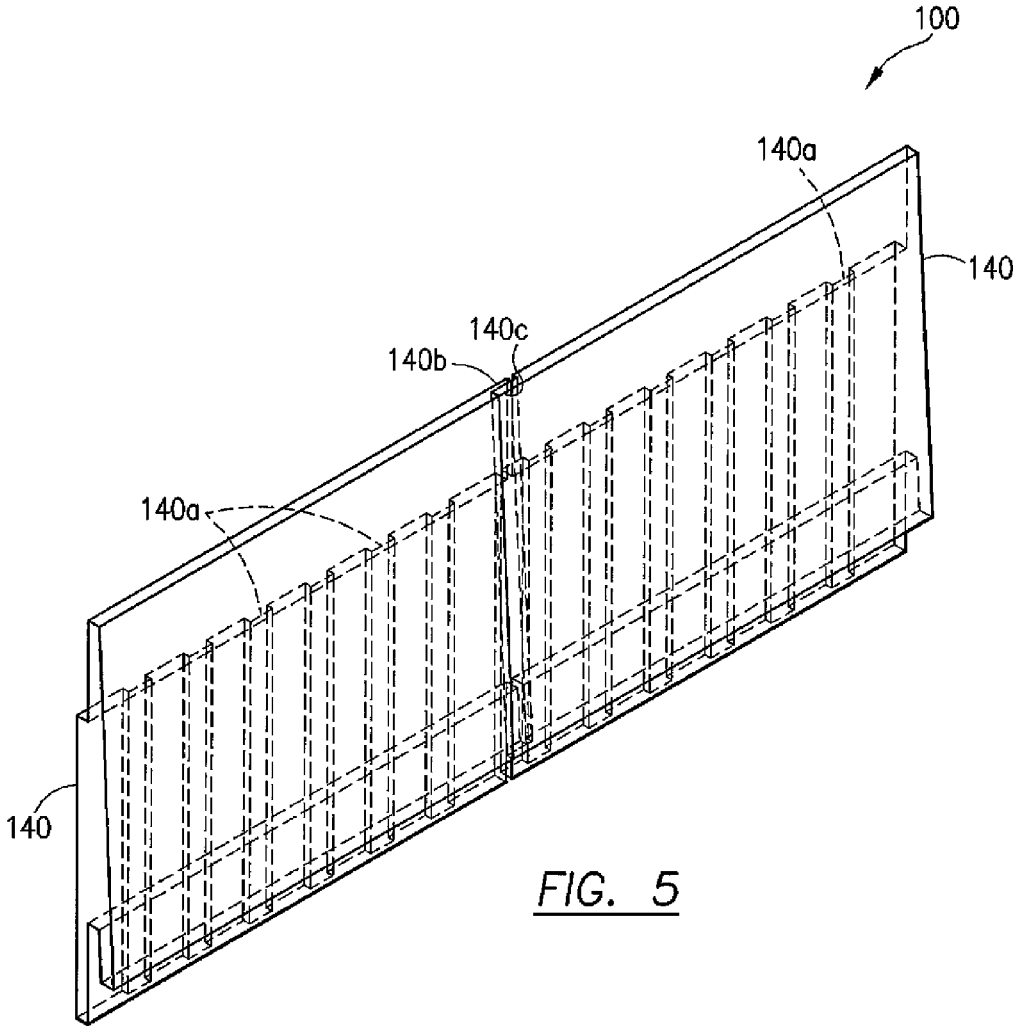
FIG. 5 shows an alternate embodiment of the invention in a perspective view with two planks joined side by side.
Figure 6:
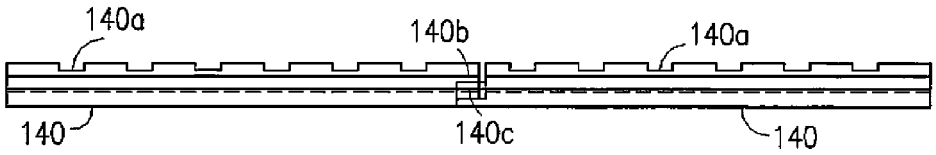
FIG. 6 shows the alternate embodiment of FIG. 5 from a top plan view.

Referring to FIGS. 5 and 6, in an alternate embodiment 100, two horizontal planks 140 are shown joined together along one edge, side by side. Each plank 140 has one or more vertical shallow channels formed in its back surface. The back surface channels can be of any cross sectional shape and are shown as rectangular. The channels are used to collect moisture that may accumulate on the exterior surface of the wall of the building being covered by the siding. As each horizontal plank row is attached to a vertical plank row above, the vertical channels 140*a* can be aligned vertically so that the plank moisture channels from the top of the wall to the bottom of the wall are aligned. The starting strip channels can also be vertically aligned. Condensate and moisture will be drained downwardly by gravity.

As shown in FIG. 6, the plank back surface channels 140*a* are shallow and rectangular grooves but could be any design or shape. Also note that in an alternate embodiment the planks 140 can be overlapped from side to side such that one plank has an extended lip 140*c* along one edge which is sized to engage a comparable recess 140*b* in the adjacent panel along each side. Thus, the panels can be overlapped laterally for moisture prevention. Note that a small channel can be disposed along the edge that shows the overlap 140*c* and 140*b* that itself could be a moisture barrier along the inside back surface between the planks 140.

Alternate Embodiment

Figure 7B:
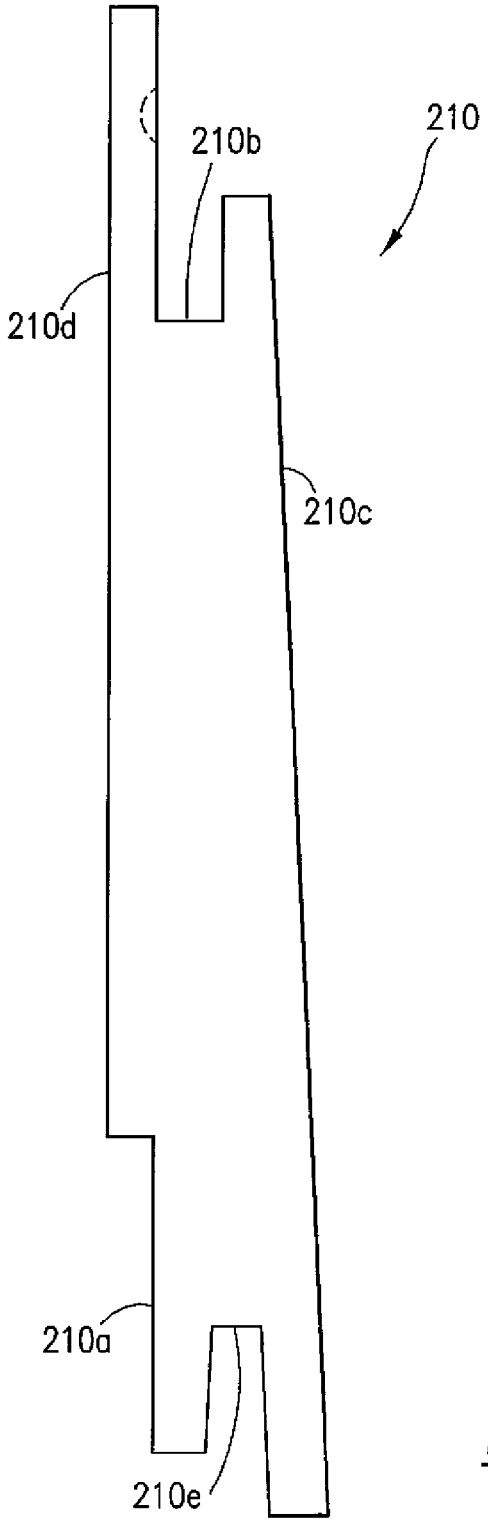
FIG. 7B shows a side elevational view of the alternate embodiment of the horizontal plank.
Figure 7A:
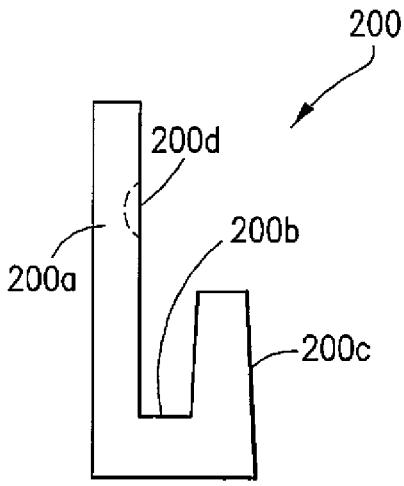
FIG. 7A shows a side elevational view of an alternate embodiment of the bottom starter strip.

As an alternative embodiment, referring now to FIG. 7A, the starting strip 200 is shown in a side elevational view to illustrate the "J-shaped" groove 200*b* formed between the back wall of the starting strip 200*a* and the front wall 200*c*. In this embodiment the starting strip 200 is installed at the bottom area of the wall to be covered. Subsequent panels 210 are then attached in an upward direction. The top plank can be attached and cut longitudinally to fit the top most row. Flashing or a sealant may be used to seal the top plank. The starting strip 200 also includes a plurality of dimples 200*d* that are circular recessed portions sized approximately in diameter to equal to the head of a nail or a screw. However, the dimples are not required. This provides a visual indication to a construction worker as to where to insert fasteners such as nails or screws that will be countersunk when the starter strip 200 is mounted to a vertical surface or wall stud.

Each starting strip 200 may additionally have a plurality of shallow vertical grooves located on the flat back wall. These grooves will extend from the bottom of the flat back wall to the top of the flat back wall.

Referring now to FIG. 7B, the basic siding plank 210 is shown that is used to complete the building siding from the bottom of the wall upwardly. Each plank 210 is mounted horizontally starting from the starting strip 200 as shown in FIG. 7A upwardly in horizontal rows. The plank 210 has a flat back wall 210*d* and an lower inverted "J-shaped" wall 210*a* and groove 210*e* which fit snuggly within the "J-shaped" groove 200*b* of the starting strip shown in FIG. 7A. The back wall 200*a* of the starter strip 200 fits into the inverted "J-shaped" groove 210*a* of the plank 210. The front wall 200*c* of the starter strip 200 fits into the second groove 210*e* of the plank 210. The top "L-shaped" portion 210*b* of the plank 210 is sized to fit snuggly in an adjacent horizontal plank into the inverted "J-shaped" groove 210*a*, and second groove 210*e* as each horizontal plank is attached to the plank above it in an upwardly pattern. The front surface 210*c* of each plank is flat but tapered to give the effect of overlapping boards and to allow water run off.

Each siding plank 210 may additionally have a plurality of shallow vertical grooves located on the back side of the plank 210*d* which will share a planar relationship with the flat back wall of the starting strip 200. These grooves will extend from the top edge to the bottom edge of the plank 210.

Alternate Embodiment

Figure 8:
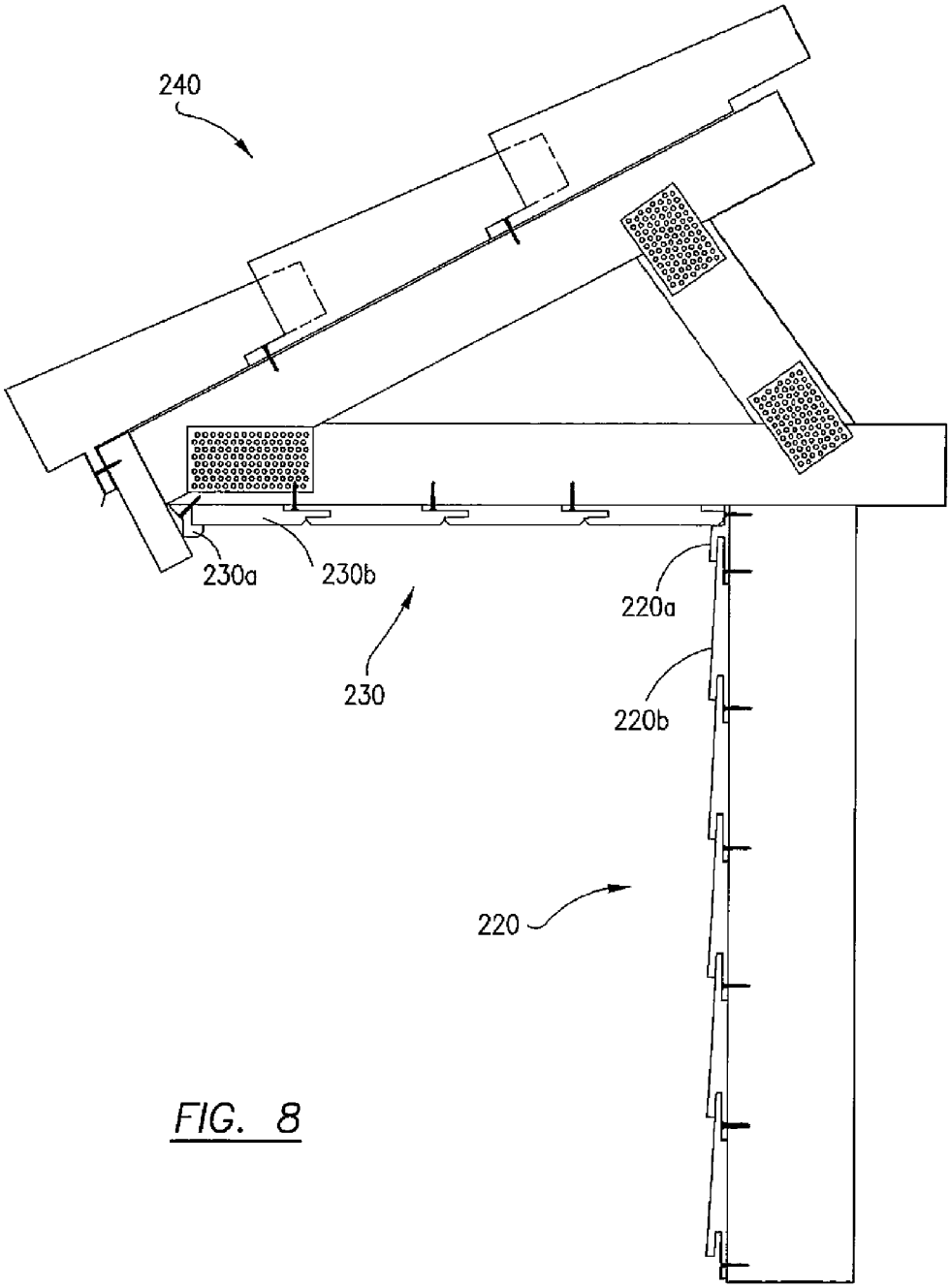
FIG. 8 shows a cross sectional view wherein the invention is used on a roof and as a soffit as well as a vertical exterior wall covering.

As an alternative embodiment, referring now to FIG. 8, the starting strip and horizontal planks 220 can also be used as soffits 230 or as roofing material 240. For the roofing material 240, the starting strip will be mounted near the top of the roof and the horizontal planks will be subsequently mounted below and downwardly. The soffits 230 are described below.

Figure 9:
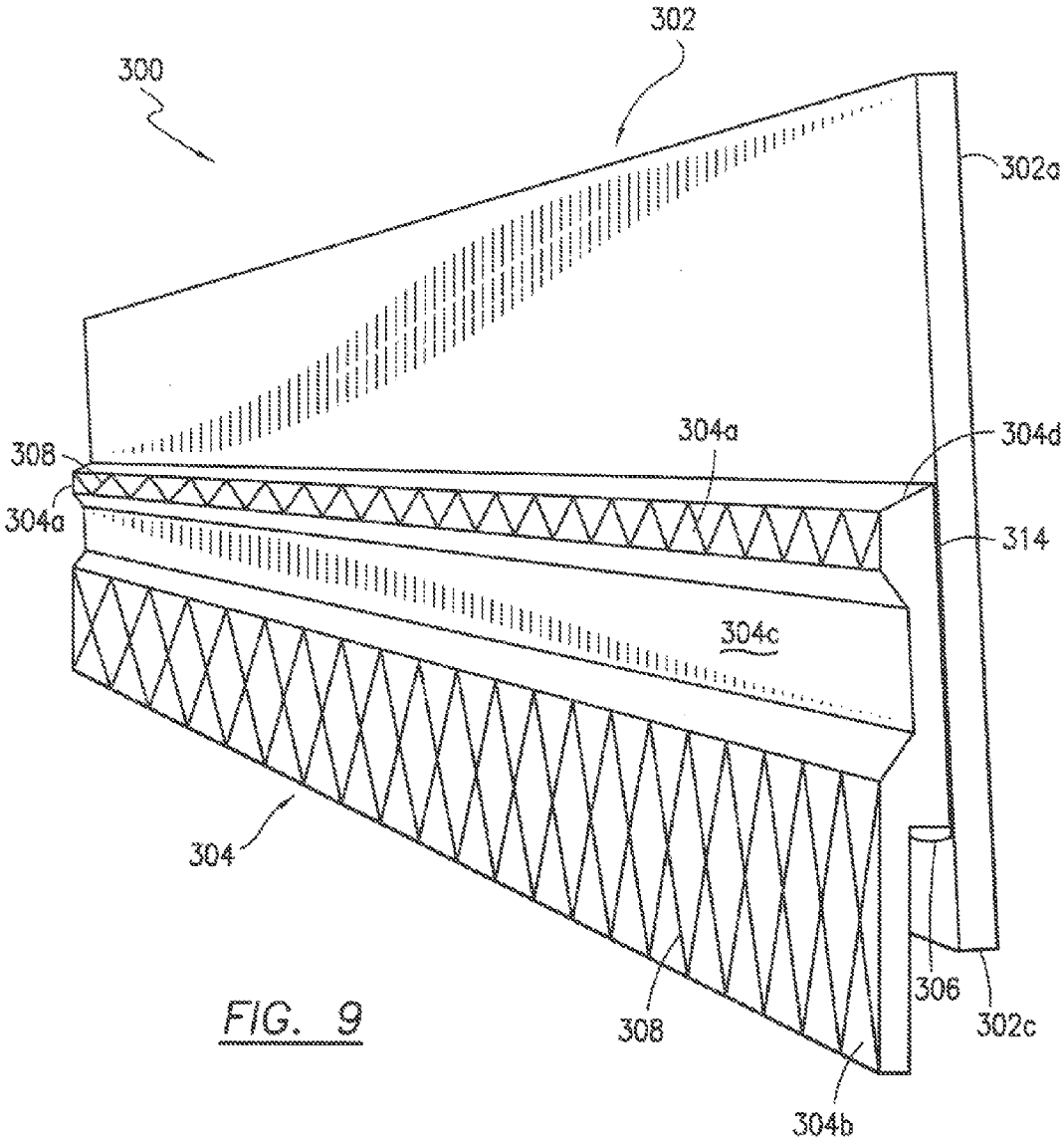
FIG. 9 shows a perspective view of a siding unit that includes a fiber cement board bonded to an adaptor strip.
Figure 10:
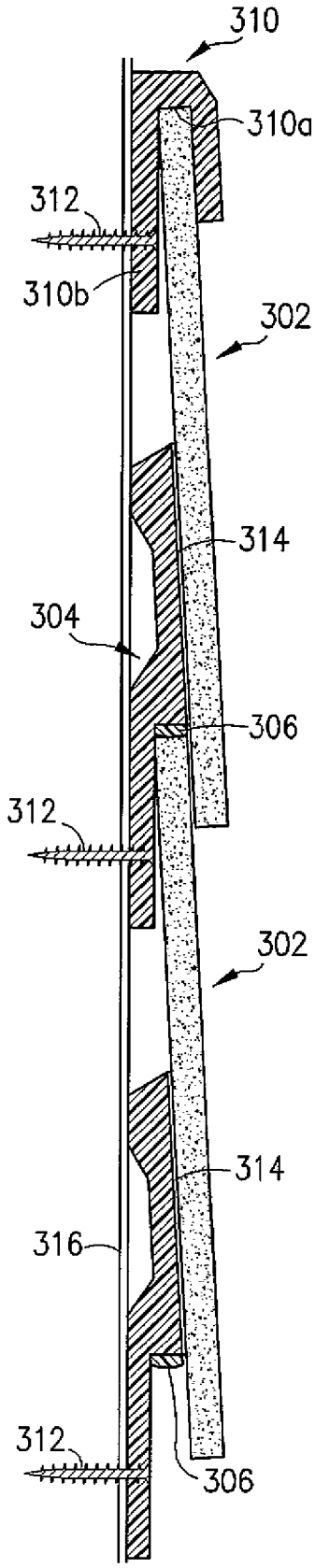
FIG. 10 shows a starting strip and a pair of siding units interlocked in a cross sectional view in elevation displaying the interlocking of the siding unit shown in FIG. 9.
Figure 11:
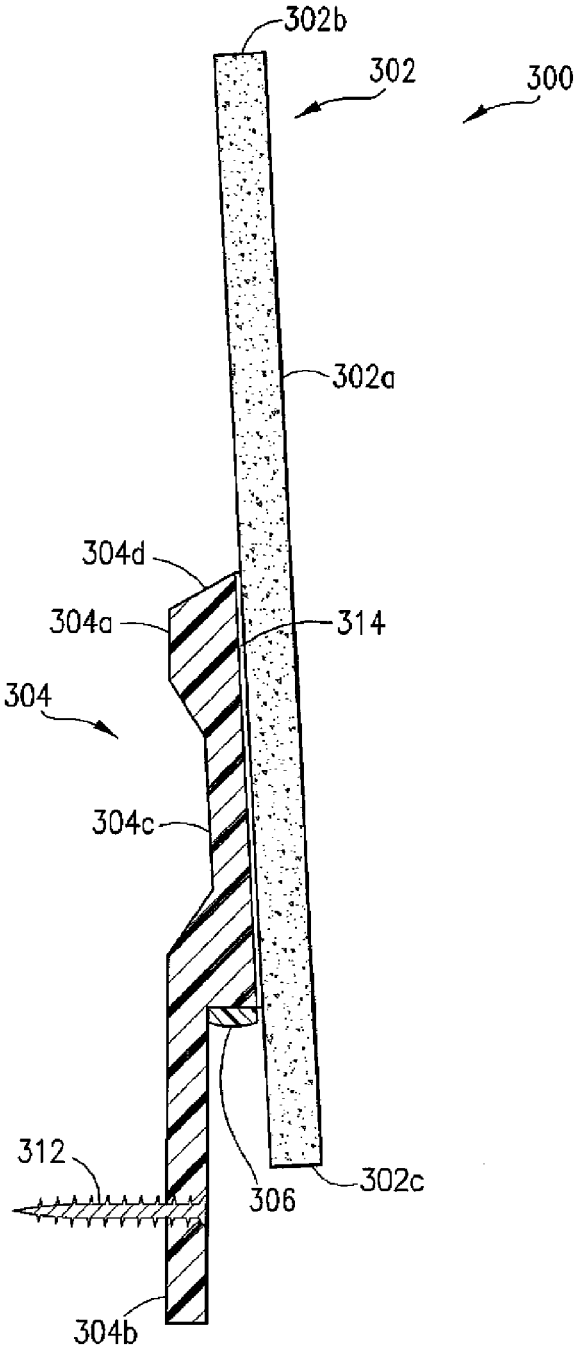
FIG. 11 shows a side elevational view in cross section of the siding unit shown in FIG. 9.

The preferred embodiment of the invention is shown in FIGS. 9, 10 and 11.

Referring now to FIGS. 9, 10 and 11, siding unit 300 includes a fiber cement rectangular panel 302 which is conventional in shape, thickness and can be of indeterminate length or standard length from a generally rectangular board shape or plank shape. On one side of the fiber cement board 302 is attached an adaptor strip 304. The adaptor strip 304 is attached and bonded to one side of the fiber cement board by adhesive 314 along the front face upper portion of said adaptor strip 304. The fiber cement plank or board 302 can be bonded to the adaptor strip 304 at the factory or in situ. The siding 300 includes a resilient water proof strip 306 that is mounted in a groove along the base of the siding unit between the front board 302 and the lower extended base of the adaptor strip 304. The purpose of the base groove is to receive the top edge of board 302 in an interlocking trap lock arrangement for wind and water protection of the exterior building and wall. The resilient water resistant strip 306 engages the top edge of fiber cement board 302 when the siding members are interlocked in a top down fashion.

FIG. 10 shows a pair of siding units inserted and engaged to a starting strip 310.

The starter strip 310 includes a groove 310*a* that receives a fiber cement board 302 upper edge in an interlocking fashion. The starting strip in FIG. 10 is shown screwed along its extended bottom surface with a fastener 312. The extended fastening area of the starter strip is shown as 310*b*.

Engaged to the starting strip is a cement board 302 that has been adhesively bonded to the adaptor strip 304. The adaptor strip 304 has upper and lower flat back surfaces that engage the wall of the building 316. The exterior wall of the building 316 could also be a stud or flat surface material. Each of the adaptor strips is attached to the building wall 316 with fasteners such as screw, nail, adhesive or staples 312. Each siding unit made up of the fiber cement board 302 and the adaptor strip 304 is interlocked from the top down in a trap lock fashion. The bottom front surface area of each adaptor strip is long enough to overlap beyond the bottom groove such that the fastener 312 can be attached. To further explain, the bottom front surface and wall of the adaptor strip extends beyond the very bottom edge of the fiber cement board 302 which forms the interlocking groove along the base of the entire siding unit being attached. There is sufficient front surface area from the adaptor strip to allow fasteners 312 to be attached along the base of the siding unit. There is also area within the inverted groove for the sealing member 306 which is resilient and water resistant such as an artificial or natural rubber strip or other material that can be sufficiently resilient to allow the board 302 to be suitably engaged with the above siding unit groove to prevent moisture and rain from reaching the inside of the unit.

Referring now to FIG. 11, specific features of the adaptor strip and the fiber cement board are shown. Specifically, the adaptor strip 304 includes an upper mid panel support 304*a* having a flat back wall surface. This mid panel support 304*a* prevents or reduces lateral board damage to board 302 from flying debris by providing extra support along the mid panel. The adhesive bond with adhesive 314 covers the entire front surface of the upper portion of adaptor strip 304 which is substantially flat and engages a mid portion of the board 302 firmly and permanently.

In addition, the adaptor strip 304 includes an extended lower base 304*b* that is a rectangular extension extending beyond the bottom surface 302*c* of the fiber cement board 302. There is sufficient front surface area exposed of the adaptor strip 304*b* to allow attachment of screws, nails, staples or adhesive 312 along the bottom area of the adaptor strip thus attaching the entire siding unit along the bottom edge horizontally across the exterior building wall being covered. There is also volume in the groove formed between the adaptor strip 304 and the cement board 302 to receive a sealing resilient moisture barrier 306 that engages the very top surface 302*b* of the fiber cement board 302 when interlocked.

A very important feature of the adaptor strip and siding unit is a large trapezoidal longitudinal recess 304*c* along the back wall that extends the entire length of adaptor strip 304. The purpose of the trapezoidal recess 304*c* is to reduce mass and volume. The adaptor strip can be extruded and by having a substantial recess that runs at least between from top to bottom a quarter and a half along the entire body length of the adaptor strip and half the thickness, a large amount of mass of material and volume is reduced in the extrusion process, reducing material costs without sacrificing strength. Also having trapezoidal shaped surfaces allows for moisture to drop by gravity along the passage walls 304*c* between moisture transmission grooves 308 which are grooves on the mid panel support 304*a* and on surface 304*b*.

In FIG. 9, the moisture transmission grooves 308 disposed in the back walls of the adaptor strip on the flat surfaces both in the mid panel support area and on the lower area may be small grooves that allow water and moisture to proceed downwardly. The surface grooves may be crisscrossed diagonally as shown or a diamond-shaped pattern or V-shaped pattern or other angled or vertical shapes that allow transmission downwardly of moisture. Different patterns and different shapes of the moisture grooves can be used.

The relative lengths of the fiber cement board or any other conventional board, including wood or any other material 302, are essentially the same lengths as the extruded adaptor strip when the two elements are joined together. Once permanently joined the siding unit 300 can be cut with a saw just like any other type of board or plank. The height and relative height between the front board 302, regardless of the material, and its thickness and the height of the adaptor strip are important to be in the proper locations for achieving the interlocking and trap lock characteristics of the siding unit itself. As shown in FIG. 9, the top edge 304*d* of the adaptor strip (which is angled for moisture to fall downward from gravity) is approximately mid range between the top and bottom of the board 302. The height of the adaptor strip 304 is such that the back lower wall 304*b* extends sufficiently beyond the bottom surface 302*c* (see FIG. 11) to allow sufficient surface area at the bottom front for the use of fasteners 312 that are driven through the lower extended surface area of adaptor strip 304*b* to secure the siding unit to a building wall from the bottom with fasteners such as nails, staples, glue or screws 312. The height of the adaptor strip is also sufficient to form a sufficient passageway or bottom groove along the entire length of the siding unit between board 302 and adaptor strip 304 to allow the board thickness top 302*b* of a lower siding unit to be trap locked into the bottom passageway of an upper siding unit. This relationship is shown in FIG. 10 in the interlocked position. The siding units are mounted from the top down.

The adaptor strip can be used with standard planks constructed of various materials using known manufacturing process such as extrusion, molding or milling without compromising the material or design integrity. The adaptor strip mounts and bonds to existing materials by the adhesive back which also provides a method of concealing the fasteners so that they are not exposed to the elements or visible. Using the adaptor strip in conjunction with a standard plank of material, the siding planks can then be engaged continuously at their top and bottom edges beginning with a starting strip in a top down fashion. This provides a self aligning installation. By using a foam or rubberized weather strip bead, water intrusion is reduced or eliminated. The adaptor strip can be made of any material but is preferably extruded from a polymer type material.

Based on studies done, it is believed that the adaptor strip can provide a design mode that is equal to two and a half times greater in strength than that of a standard plank before the use of the adaptor strip.

The overall siding unit shown allows for much quicker installation which also may reduce construction costs.

Figure 12:
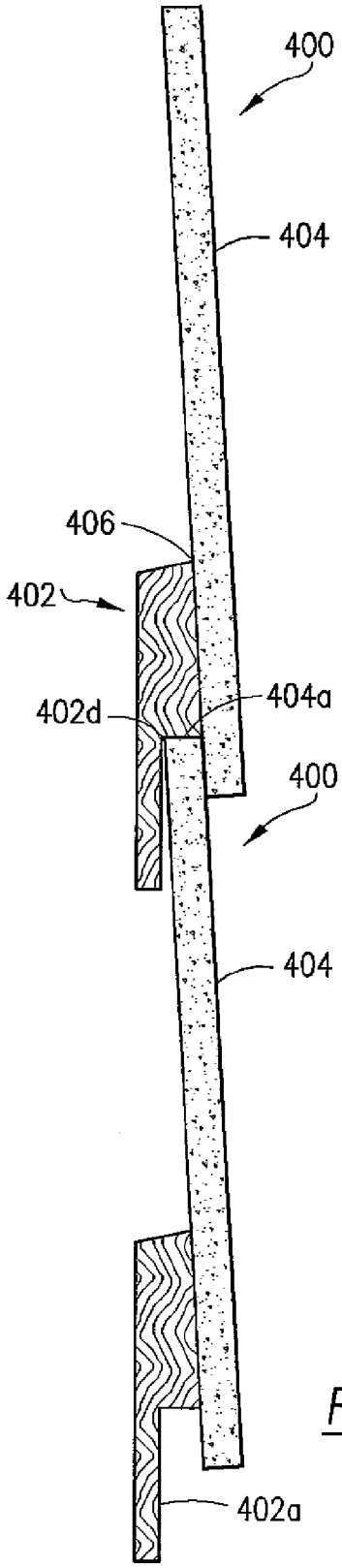
FIG. 12 is a side cross sectional view of the alternate embodiment shown in FIG. 13 attached to a conventional plank such as a fiber cement board.
Figure 13:
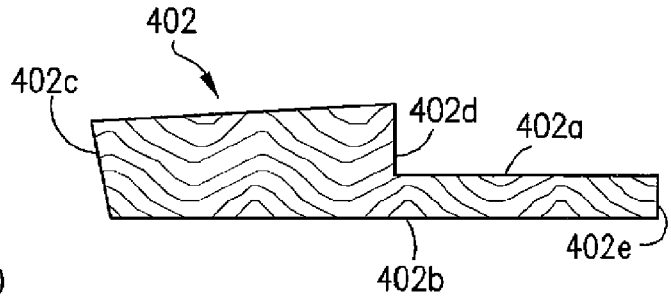
FIG. 13 shows a side elevational view of a cross section of another alternate embodiment of the present invention.

Referring now to FIGS. 12 and 13, a modified adapter strip is shown which is adaptor strip 402 that includes an extended male protrusion 402*e* formed by a L-shaped recess along sides 402*d* and 402*a*. The top 402*c* of adaptor 402 can be angled to allow moisture to drip downwardly.

The modified adaptor strip 402 is shown in its working position in FIG. 12 where it has been adhesively attached to a standard plank or board 404 by adhesive 406 and strategic position near the lower position of one side of board 404 to provide the L-shaped recessed groove along the combination of board 404 and adaptor strip 402 which is the same length as the board 404 all the way along. Note that the lower siding unit 400 as shown in FIG. 12 fits snuggly into the lower recessed groove having wall 402*d* where it intersects with the top of the lower board 404*a*. Thus, as shown in FIG. 12, the adaptor strip 402 extends the entire length of board or plank 404 which could be fiber cement board or any other conventional material, all of which is mounted on the building as shown in previous examples through the fastening area 402*a* shown in the bottom siding unit 400 of FIG. 12.

The adaptor strip front flat upper wall surface attached to said cement fiber board is not parallel to said adaptor strip as shown in FIGS. 10-13 such that when the cement fiber boards are interlocked and nailed in place, the cement fiber boards are angled relative to a building wall.

FIG. 8 and FIGS. 14-17 show the use of the invention to form a soffit 230.

Figure 15:
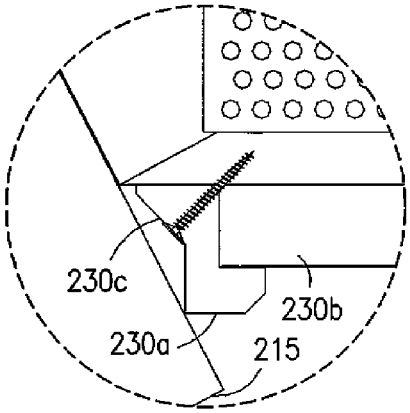
FIG. 15 shows an enlarged view of the soffit "Z" finishing strip used with the present invention for a soffit.

FIG. 15 shows an enlarged view of the soffit finishing strip 230*a* at the outside of the soffit on the outside edge of the building near the facia board 215. The purpose of the finishing strip 230*a* is to provide an ending strip for the outside of the soffit formed with the interlocking strips 230*b* shown in FIG. 8 and FIG. 14. The Z-shaped finishing strip 230*a* has an angled wall 230*c* as shown in cross section in FIG. 15 that allows the use of a screw or nail fastener for nailing the finishing strip to a structure above the soffit. Note that the finishing strip 230*a* has an L-shaped portion that receives a flat end of the interlocking plank 230*b*. Thus, the end surface of 230*b* has been modified so that it is straight and rectangular so that it fits into the finishing strip 230*a*.

Figure 16:
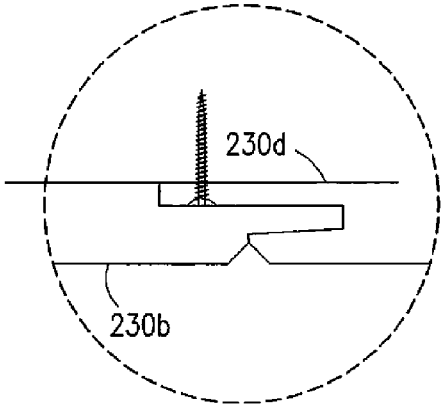
FIG. 16 shows an enlarged cross section view partially cut away of the soffit structure as it is attached to rafter tails.
Figure 14:
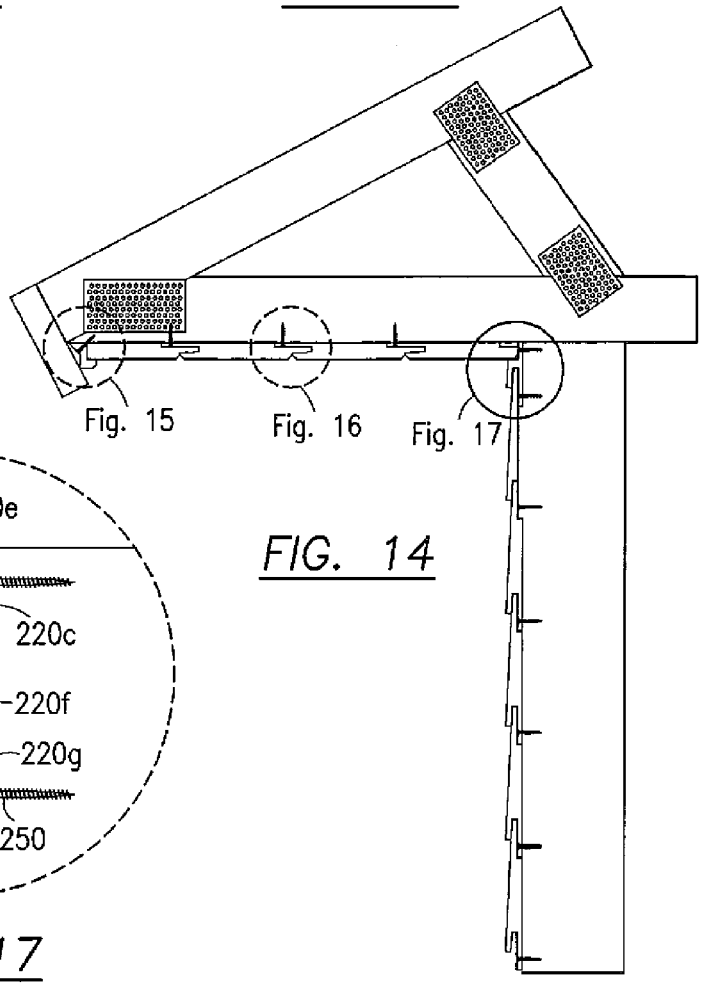
FIG. 14 is a side elevational in cross section similar to FIG. 8 showing other figure enlargements.

FIG. 16 shows an enlarged view of the soffit pieces that include an interlocking plank 230*b* with an adjacent interlocking plank 230*d* forming the entire interlock soffit with the fastener screw or nail mounted in the area of the lower back edge as has been shown throughout for the invention.

Figure 17:
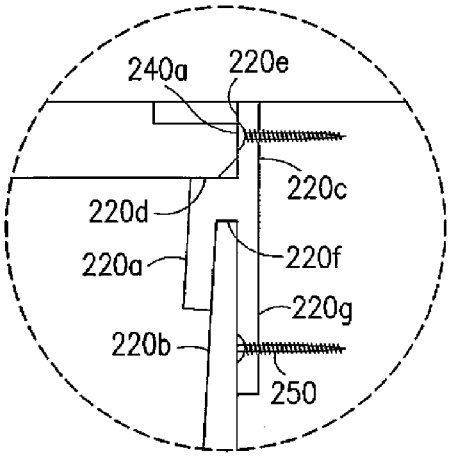
FIG. 17 shows a side elevational view in cross section of the starter strip used for siding where it joins the soffit.

FIG. 17 shows a top wall mounting soffit starter strip that can be used for the top down trap lock system for siding. At the intersection of the most inward soffit plank and the starting strip 220*a* at the top of a wall, as shown in FIG. 17, the soffit plank end face that intersects with the siding soffit starting strip 220*a* has been modified. The plank 240 includes a flat end portion 240*a* that fits into the L-portion 220*e* formed on the upper surface by protrusion of the starter strip 220*a* that includes a back flush side 220*c*. The starter strip 220*a* does include the base interlock groove 220*f* and an extended base 220*g* that extends beyond the front face of 220*a* so that the fastener 250 still can be attached to the starting strip at the top of the exterior building wall where it meets the soffit. The fastener 250 extends through fastening area of the extension 220*g* of starting strip 220*a* into the building wall. Thus, in construction jobs where the siding not only is put on the exterior walls of the building but the soffit also includes the trap lock system of interlocking adjacent planks the starting strip 220*a* is used. The soffit has its own finishing strip 230*a* for the outside facia board intersection.

Figure 18:
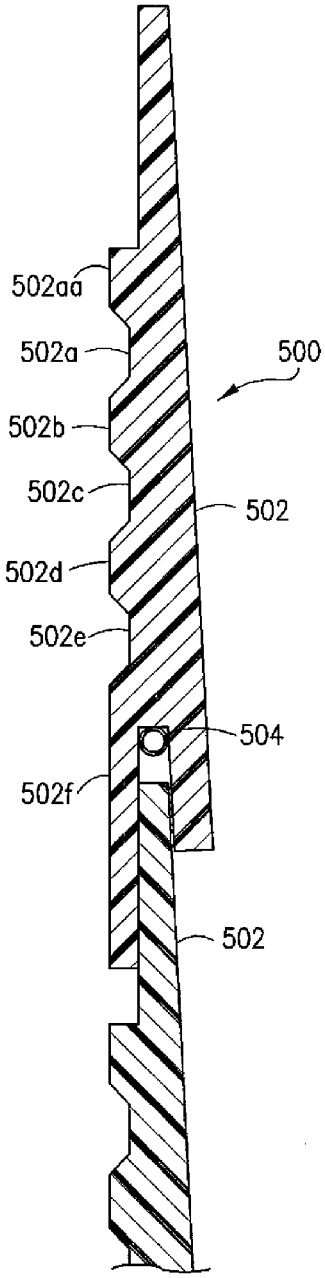
FIG. 18 shows a cross sectional view of two overlapping planks prior to being interlocked in a side elevational cross sectional view of another alternate embodiment of the invention.
Figure 19:
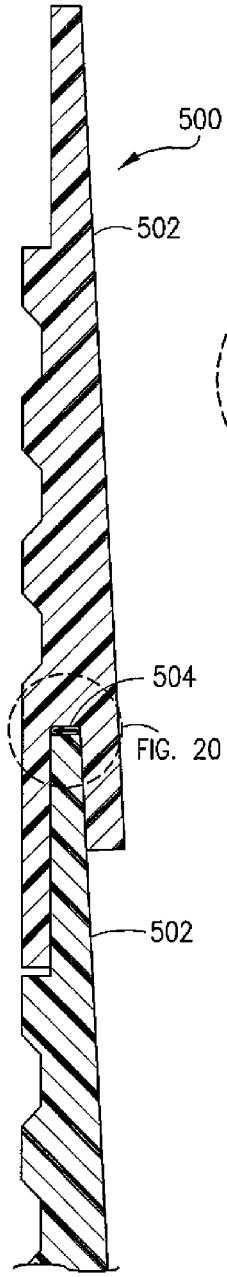
FIG. 19 shows the cross sectional side elevational view of FIG. 18 wherein the panels are in an interlocked position that includes the moisture stop in the alternate embodiment of the invention.
Figure 20:
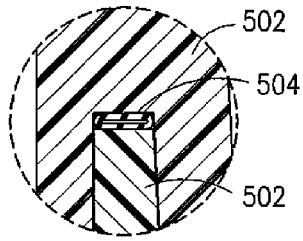
FIG. 20 is an enlarged cutaway in cross section of the moisture stop locked in place.

Referring now to FIGS. 18-20, yet another alternate embodiment of the invention is shown with an integrally formed plank system 500 that includes individual planks 502.

With the planks 502, which could be extruded, milled or molded, additional recessed areas 502*a*, 502*c* and 502*e* run parallel longitudinally along the back wall of each plank to reduce the mass or volume of material used. In addition, the flat back surfaces provide for support platforms 502*b*, 502*d* and 502*aa*. These flat support platforms are disposed on each side of the recesses to prevent damage to the plank from flying debris if the plank were not supported properly.

The optional alternate embodiment of the invention shows the use of a resilient, artificial or natural rubber moisture stop 504 which is mounted in the base groove of each plank and which, because of its resilience, can be compressed when the lower plank is inserted into the bottom groove of the adjacent plank for interlocking. As shown in FIG. 20, the moisture stop will be deformed and expand to provide a moisture barrier 504 between each interlocked plank along its length. Thus, the moisture barrier or moisture stop 504 will run the entire length of the base groove in each plank. Different types of materials could be used and it does not have to be an O-ring in cross section as shown in FIG. 17. It is important that the material be resilient, however, so that it can conform when the above and below planks are interlocked together. The plank fasteners are not shown in FIGS. 17 and 18 but would be disposed through the back wall portion 502*f* which is the extended area for fasteners in attaching the planks 502 to an exterior wall.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. Siding for a building exterior wall that can be attached to the side wall of a building including a stud or a flat building surface, said siding mounted to an exterior wall of a building, said siding comprising:

a fiber cement siding board, said fiber cement siding board being substantially elongated between a first end and a second end along a longitudinal direction to a predetermined length and said fiber cement siding board having a rectangular cross section of a pre-determined vertical height and a uniform thickness;

an adaptor strip that includes a longitudinally elongated body, said elongated adaptor strip body having a substantially flat upper front wall surface, an L-shaped lower front wall surface and an angled downwardly top edge;

said adaptor strip having a first end and a second end including a body having an upper rear flat back wall surface and a lower rear flat back wall surface, said adaptor strip body upper rear flat back wall surface and lower rear flat back wall surface being coplanar and separated by a channel disposed longitudinally in said adaptor strip body from said first end to said second end, directly opposite said upper front wall surface, said channel configured to reduce the amount of mass and volume of material in said adaptor strip and also to allow moisture passage substantially vertically, said adaptor strip lower front wall recessed in an L-shape in a different plane and recessed from said upper front wall surface of said adaptor strip;

an adhesive layer attaching said adaptor strip upper front wall surface to said siding board;

said fiber cement siding board having a front flat surface and a rear flat surface and a bottom flat surface and a top flat surface, said fiber cement siding board attached on its rear flat surface by said adhesive layer to the flat upper front wall surface of said adaptor strip along its complete length longitudinally, said fiber cement siding board bottom flat surface extending below said adaptor strip upper front wall surface forming a trapezoidally shaped longitudinal groove with the L-shaped lower front wall surface of said adaptor strip, said trapezoidally shaped groove being sized in thickness to receive said fiber cement siding board top flat surface from an adjacent interlocked lower fiber cement siding board and an interlock for trap locking said fiber cement siding board top flat surface of said adjacent lower fiber cement siding board;

said adaptor strip attached to said fiber cement siding board at a specific location and extending the entire length of the fiber cement siding board, said adaptor strip L-shaped lower front wall having a lower portion that extends vertically below the bottom flat surface of said fiber cement board delimiting an open surface area on said adaptor strip; and one or more fasteners received through said open surface area on said adaptor strip to secure said adaptor strip and said fiber cement siding board to the exterior wall of the building without said one or more fasteners penetrating said fiber cement siding board.

2. Rectangularly shaped building siding cement fiber board having an adaptor strip mounted on one side for attaching the cement fiber board to a building comprising:

a plank-sized cement fiber board for use as building siding, said cement fiber board having a flat front side and a parallel flat back side, a first end and second end, a top and a bottom;

said cement fiber board having a lateral rectangular cross section of uniform thickness;

an adhesive;

an adaptor strip connected to said cement fiber board on the back side of said cement fiber board by said adhesive, said adaptor strip extending from said cement fiber board first end to said second end longitudinally;

said adaptor strip having a top surface angled downwardly, first and second bottom surfaces, a front flat surface and a back flat surface;

said front flat surface having an upper front flat surface and a lower front flat surface recessed from said upper front flat surface;

said back flat surface having an upper back flat surface and a lower back flat surface separated by a channel disposed longitudinally in said adaptor strip and directly opposite said upper front flat surface, said channel configured to reduce the volume of the adaptor strip;

said adaptor strip upper front flat surface attached by said adhesive to said cement fiber board back surface at a predetermined location between the top and bottom of said cement fiber board;

said adaptor strip back flat surface sized longer than said upper front flat surface, said adaptor strip first bottom surface being perpendicular to said adaptor strip back flat surface and disposed below said cement fiber board bottom providing a trapezoidally shaped longitudinal groove and delimiting an open surface area on said adapter strip extending the length of said adaptor strip below said cement fiber board bottom;

one or more fasteners received through said open surface area on said adaptor strip to attach said cement fiber board and said adaptor strip to a building without said one or more fasteners penetrating said cement fiber board; and said cement fiber board top sized to interlock with an above cement fiber board and said adaptor strip trapezoidally shaped groove between the cement fiber board and the adaptor strip.

* * * * *